US008523329B2

(12) United States Patent
Tamaru et al.

(10) Patent No.: US 8,523,329 B2
(45) Date of Patent: Sep. 3, 2013

(54) INKJET PRINTHEAD SUBSTRATE, INKJET PRINTHEAD, AND INKJET PRINTING APPARATUS

(75) Inventors: Yuji Tamaru, Yokohama (JP); Yoshiyuki Imanaka, Kawasaki (JP); Hideo Tamura, Kawasaki (JP)

(73) Assignee: Canon Kabushiki Kaisha, Tokyo (JP)

( * ) Notice: Subject to any disclaimer, the term of this patent is extended or adjusted under 35 U.S.C. 154(b) by 339 days.

(21) Appl. No.: 13/023,849

(22) Filed: Feb. 9, 2011

(65) Prior Publication Data

US 2011/0210997 A1 Sep. 1, 2011

(30) Foreign Application Priority Data

Mar. 1, 2010 (JP) ..... 2010-044629

(51) Int. Cl.
*B41J 2/05* (2006.01)

(52) U.S. Cl.
USPC ..... 347/58

(58) Field of Classification Search
CPC ..... B41J 2/14129
USPC ..... 347/9, 54, 56, 63, 58, 59, 62
See application file for complete search history.

(56) References Cited

U.S. PATENT DOCUMENTS

| | | | | |
|---|---|---|---|---|
| 5,463,412 | A * | 10/1995 | Matsuda | 347/43 |
| 5,731,826 | A | 3/1998 | Hirano | |
| 5,821,960 | A * | 10/1998 | Mitani | 347/58 |
| 6,109,733 | A * | 8/2000 | Raisanen et al. | 347/63 |
| 6,357,862 | B1 | 3/2002 | Ozaki et al. | |
| 6,530,650 | B2 * | 3/2003 | Ozaki et al. | 347/64 |
| 6,962,405 | B2 | 11/2005 | Imanaka et al. | |
| 7,374,275 | B2 | 5/2008 | Shibata et al. | |
| 2008/0273053 | A1 | 11/2008 | Takeuchi et al. | |

FOREIGN PATENT DOCUMENTS

| | | |
|---|---|---|
| JP | 7-32608 | 2/1995 |
| JP | 2006-51770 | 2/2006 |
| JP | 2006-231857 | 9/2006 |

* cited by examiner

*Primary Examiner* — An Do
(74) *Attorney, Agent, or Firm* — Fitzpatrick, Cella, Harper & Scinto

(57) ABSTRACT

An inkjet printhead substrate includes: a pair of individual conductive layers configured to supply electrical power to a heat generation element; a first common conductive layer configured to be connected to one of the pair of individual conductive layers; a second common conductive layer configured to be connected to the other of the pair of individual conductive layers; and an isolation layer configured to be provided between the one of the pair of individual conductive layers and the first common conductive layer, and between the other of the pair of individual conductive layers and the second common conductive layer, wherein the isolation layer is formed from a conductive material which has a lower solubility in ink than a material used for the pairs of individual conductive layers, the first common conductive layer and the second common conductive layer.

19 Claims, 14 Drawing Sheets

INKJET PRINTHEAD SUBSTRATE, INKJET PRINTHEAD, AND INKJET PRINTING APPARATUS

BACKGROUND OF THE INVENTION

1. Field of the Invention

The present invention relates to an inkjet printhead substrate, inkjet printhead, and inkjet printing apparatus.

2. Description of the Related Art

In a general thermal inkjet printhead, discharge heaters for discharging ink, and lines for electrical connection are formed on the same substrate, and nozzles for discharging ink are formed on them.

Recently, inkjet printing techniques are actively expanding to large-format printing presses, commercial printing presses, and like. Large-format printing presses, commercial printing presses, and like are larger in printing amount and higher in print processing frequency, compared to home printers, office copying machines, and the like. In other words, to promote expansion of inkjet techniques to large-format printing presses, commercial printing presses, and the like, inkjet printheads need to be more durable than conventional ones.

One means for improving the durability of the inkjet printhead is a discharge failure detection & discharge failure compensation technique. The discharge failure detection & discharge failure compensation technique is a technique of minimizing adverse effects on a printed image even if a predetermined number of heaters become unavailable. In general, if even one heater fails, a corresponding nozzle does not discharge an ink droplet, generating a defect such as a white stripe in a printed image. It is determined that the inkjet printhead fails in the printing operation when discharge failures occur in a relatively small number of heaters. However, the discharge failure detection & discharge failure compensation technique can be used to suppress degradation of a printed image caused by a predetermined number of discharge failures. This technique allows increasing the heater trouble count threshold at which it is determined that the printhead fails in the printing operation, improving the durability of the printhead.

A known example of the discharge failure detection technique is a technique disclosed in Japanese Patent Laid-Open No. 07-032608. In this technique, a failed heater is specified using a vibration plate. An ink droplet is discharged to the vibration plate capable of electrically or magnetically detecting a displacement. A failed nozzle is detected based on the presence/absence of a displacement of the vibration plate.

A known example of the discharge failure compensation technique is a technique disclosed in Japanese Patent Laid-Open No. 2006-231857. In this technique, the interval between the driving timings of heaters adjacent to each other is suppressed to be equal to or shorter than the cycle of ink refill to the nozzle. At one discharge timing, a nozzle adjacent to a discharge failure nozzle discharges ink droplets twice. Generally in the discharge failure compensation technique, another heater corresponding to a discharge failure heater is used as an alternative heater.

In addition to the durability of the printhead, downsizing is also requested of the printhead substrate. One factor which defines the substrate size is securement of the heater line region. For example, sharing heater lines is very effective for reduction of the substrate size. When sharing heater lines, it is necessary to minimize the influence of the heater line resistance difference in the heater array on the ink droplet discharge performance.

FIG. 10 is a view exemplifying the arrangement of an inkjet printhead substrate in which heater lines are partially shared. Heater arrays 210 are respectively arranged on the two sides of an ink supply port 240. Power supply pads 231 are prepared at the two ends of one heater array. Further, the heater array 210 is divided into six blocks, and heaters belonging to the respective blocks are connected to a common heater line 220. The line width of the common heater line 220 is adjusted in accordance with the distance to the power supply pad 231 so that the heater line resistances of the respective blocks become almost equal to each other.

The enlarged view of a region K showing some of the blocks of the heater array 210 shows heaters 211 and switching elements 251. The enlarged view also shows a driving voltage-side common heater line 221 connected to a heater driving voltage supply pad, a ground-side common heater line 223 connected to a ground voltage supply pad, a driving voltage-side individual heater line 222, and a ground-side individual heater line 224. The switching element 251 is formed using a lower conductive layer and gate electrode layer. The switching element 251 is arranged in correspondence with the heater 211 and heater line via a heat storage layer (second heat storage layer 150). The switching element 251 is electrically connected to the ground-side individual heater line 224 via a through hole 264 serving as the opening of the second heat storage layer 150, and further electrically connected to the ground-side common heater line 223 via a through hole 263. In the conventional technique typified by FIG. 10, the driving voltage-side common heater line 221 is laid out by folding it back at the heater block end while the ground-side common heater line 223 is laid out straight. This layout makes line resistances in the heater blocks to be almost equal.

Further, the heater 211 and heater line are covered with a passivation film layer made of an insulating material, and are protected from ink or the like. At a portion of the passivation film layer that corresponds to the heater 211, an anti-cavitation layer is formed to protect the heater 211 from cavitation generated when ink is bubbled and discharged.

FIG. 11 is a view exemplifying the arrangement of an inkjet printhead substrate in which heater lines are completely shared. The heater arrays 210 are respectively arranged on the two sides of the ink supply port 240. The power supply pads 231 are arranged at the two ends of one heater array. All heaters belonging to the heater array are connected to the common heater line 220. This heater line arrangement is effective when the resistance component of the common heater line is much lower than that of the heater line, and the influence of the heater line resistance difference between the end and center of the heater array on the ink droplet discharge performance is small. That is, as long as the influence on the ink droplet discharge performance and the like are small, the arrangement shown in FIG. 11 can implement a more efficient line layout than the partially shared heater line as shown in FIG. 10.

As described above, sharing heater lines is effective for realizing an efficient line layout. However, in the use of this arrangement, discharge failures readily occur in chains in successive heaters.

A mechanism of successively generating discharge failures in a plurality of heaters will be explained. FIG. 12A exemplifies the periphery of heaters on a printhead substrate in which heater lines are partially shared. FIG. 12A shows a state immediately after a passivation film layer covering one heater is disconnected due to some influence, and a heat resistance layer which forms the heater, and an individual heater line contact ink. A heater which fails in discharge is shown in a frame of a broken line.

If the passivation film layer is disconnected to directly expose the individual heater lines 222 and 224 to ink, the heater line material elutes over time, and corrosion of the heater line proceeds. Note that L is corrosion of the heater line. In this specification, corrosion means a line state in which a line is ionized and dissolved by ink to generate a heater discharge failure.

FIG. 12B is a view exemplifying a case in which the printhead substrate shown in FIG. 12A is kept used after the passivation film layer is disconnected. In this case, the corrosion L of the heater line propagates to the driving voltage-side common heater line 221, cutting off supply of the heater driving voltage to heaters 213 connected to the same common heater line. As a result, even heaters connected to the same common heater line as that of a heater in which a discharge failure has occurred first become unavailable.

In this case, the above-mentioned discharge failure detection & discharge failure compensation technique may be applied. However, the discharge failure compensation technique uses another heater as an alternative heater to compensate for a heater suffering a discharge failure. If the number of heaters having discharge failures increases, discharge failure compensation is impossible. In compensation using adjacent nozzles, if heater troubles concentrate at a specific portion, color irregularity cannot be satisfactorily reduced.

That is, to effectively improve the head durability by discharge failure detection and discharge failure compensation in a printhead having a printhead substrate in which heater lines are shared, an arrangement which suppresses the phenomenon in which discharge failures are successively generated in a plurality of heaters is required.

To solve the above problem, Japanese Patent Laid-Open No. 2006-51770 proposes a technique of arranging an electrode using a corrosion-resistant metal in the boundary region between the heater line portion and the heater portion, and suppressing propagation of corrosion of a line to another heater even if a passivation film layer corresponding to one heater is disconnected. However, this technique requires an additional corrosion-resistant metal layer step in the substrate formation process. This may raise the substrate cost and decrease the productivity.

SUMMARY OF THE INVENTION

The present invention provides a technique capable of suppressing the phenomenon in which discharge failures are successively generated in a plurality of heaters, without adding a new substrate formation process.

According to a first aspect of the present invention, there is provided an inkjet printhead substrate comprising: a pair of individual conductive layers configured to supply electrical power to a heat generation element which generates thermal energy for discharging ink; a first common conductive layer configured to be connected to one of the pair of individual conductive layers, and supply electrical current to the pair of individual conductive layers; a second common conductive layer configured to be connected to the other of the pair of individual conductive layers, wherein the electrical current flows into the second common conductive layer from the pair of individual conductive layers; and an isolation layer configured to be provided between the one of the pair of individual conductive layers and the first common conductive layer, and between the other of the pair of individual conductive layers and the second common conductive layer, wherein the isolation layer is formed from a conductive material which has a lower solubility in ink than a material used for the pairs of individual conductive layers, the first common conductive layer and the second common conductive layer.

According to a second aspect of the present invention, there is provided an inkjet printing apparatus comprising: an inkjet printhead using above described inkjet printhead substrate; a control unit configured to control a first switching element and a second switching element; and a detection unit configured to detect whether ink has been discharged from an orifice arranged in correspondence with a heat generation element, wherein when the detection unit detects that no ink has been discharged, the control unit controls to turn off at least one of the first switching element and second switching element which are connected to the heat generation element.

Further features of the present invention will be apparent from the following description of exemplary embodiments (with reference to the attached drawings).

BRIEF DESCRIPTION OF THE DRAWINGS

The accompanying drawings, which are incorporated in and constitute a part of the specification, illustrate embodiments of the invention, and together with the description, serve to explain the principles of the invention.

DESCRIPTION OF THE EMBODIMENTS

An exemplary embodiment(s) of the present invention will now be described in detail with reference to the drawings. It should be noted that the relative arrangement of the components, the numerical expressions and numerical values set forth in these embodiments do not limit the scope of the present invention unless it is specifically stated otherwise.

Note that the following description will exemplify a printing apparatus which adopts an inkjet printing system. The printing apparatus may be, for example, a single-function printer having only a printing function, or a multi-function printer having a plurality of functions including a printing function, FAX function, and scanner function. Also, the printing apparatus may be, for example, a manufacturing apparatus for manufacturing a color filter, electronic device, optical device, micro-structure, or the like using a predetermined printing method.

In the following description, "printing" means not only forming significant information such as characters or graphics but also forming insignificant information. In addition, "printing" means forming an image, design, pattern, structure, or the like on a printing medium in a broad sense regardless of whether the formed information is visualized so that a person can visually perceive it, and also means processing a medium.

In addition, a "printing medium" means not only paper used in a general printing apparatus but also ink receivable members such as cloth, plastic film, metal plate, glass, ceramics, resin, lumber, and leather.

Further, "ink" should be interpreted in a broad sense as in the above-mentioned definition of "printing". "Ink" means a liquid which can be used to form an image, design, pattern, or the like, process a printing medium, or perform ink processing (for example, solidification or insolubilization of a coloring material in ink supplied to the printing medium) when the ink is applied onto the printing medium. Also, "nozzle" generically means an orifice, a liquid channel communicating with it, and an element which generates energy used to discharge ink, unless otherwise specified.

Figure 1A:
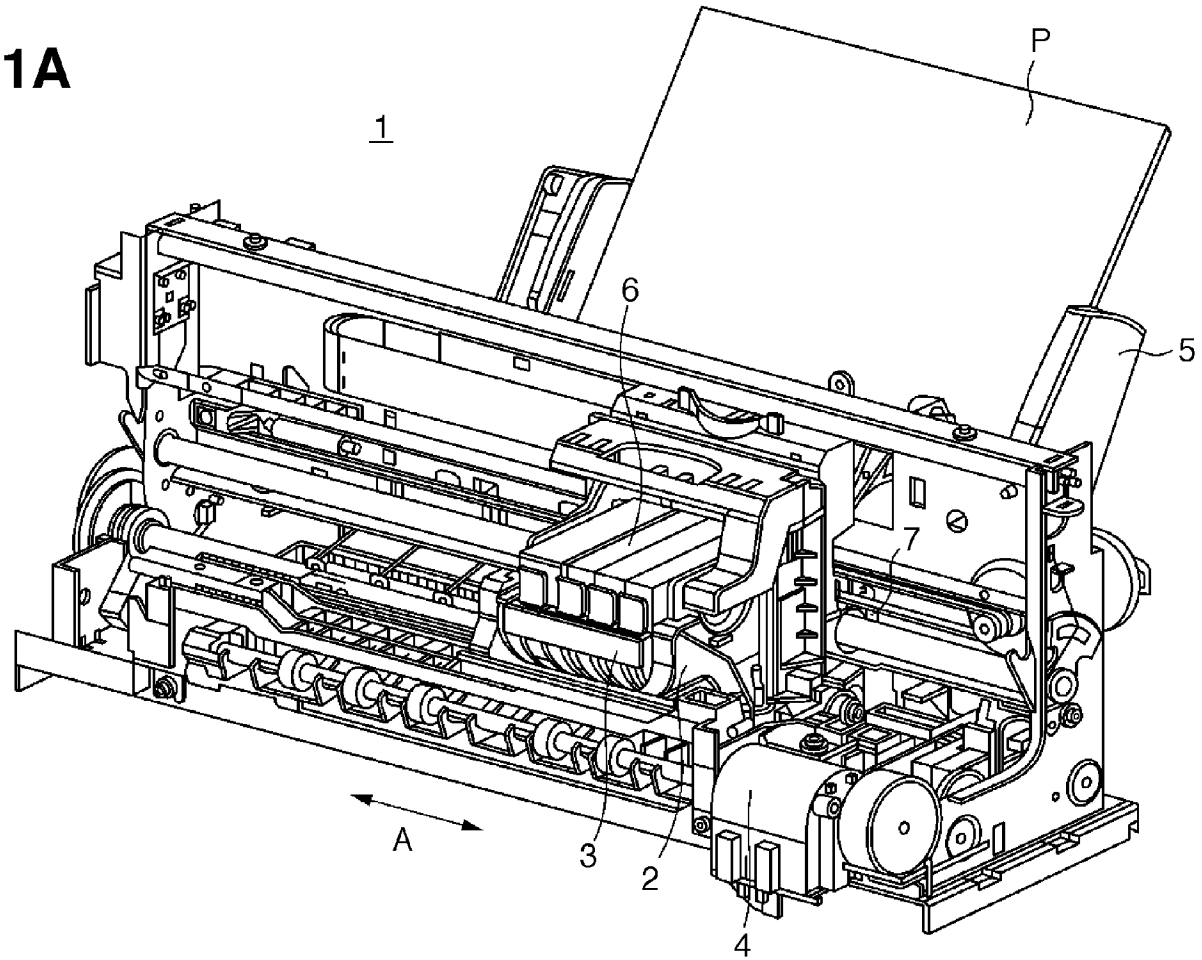
FIG. 1A is a perspective view of a printing apparatus according to the present invention.

FIG. 1A is a perspective view exemplifying the outer appearance of an inkjet printing apparatus (to be referred to as a printing apparatus) 1 according to one embodiment of the present invention.

In the printing apparatus 1, an inkjet printhead (to be referred to as a printhead) 3 which prints by discharging ink according to an inkjet method is mounted in a carriage 2. The carriage 2 reciprocates in directions (scanning direction) indicated by an arrow A to print. The printing apparatus 1 feeds a printing medium P such as printing paper via a paper feed mechanism 5, and conveys it to a printing position. At the printing position, the printhead 3 prints by discharging ink to the printing medium P.

The carriage 2 of the printing apparatus 1 supports, for example, an ink cartridge 6 in addition to the printhead 3. The ink cartridge 6 contains ink to be supplied to the printhead 3. Note that the ink cartridge 6 is detachable from the carriage 2.

The printing apparatus 1 shown in FIG. 1A can print in color. For this purpose, the carriage 2 supports four ink cartridges which contain, for example, magenta (M), cyan (C), yellow (Y), and black (K) inks, respectively. The four ink cartridges are independently detachable.

The printhead 3 has an inkjet printhead substrate (to be also simply referred to as a substrate), and a plurality of nozzle arrays are laid out on the substrate. The printhead 3 uses, for example, an inkjet method of discharging ink using thermal energy. Thus, the printhead 3 includes printing elements such as heat generation elements (to be also referred to as heaters), and control circuit which controls driving of the printing elements. The heater is arranged in correspondence with each nozzle (orifice), and a pulse voltage is applied to a corresponding heater in accordance with a printing signal.

A recovery apparatus 4 is arranged outside the range of reciprocal movement of the carriage 2 (outside the printing region) to recover the printhead 3 from a discharge failure. The position where the recovery apparatus 4 is arranged is called a home position or the like, and the printhead 3 stands still at this position while no printing operation is done.

Figure 1B:
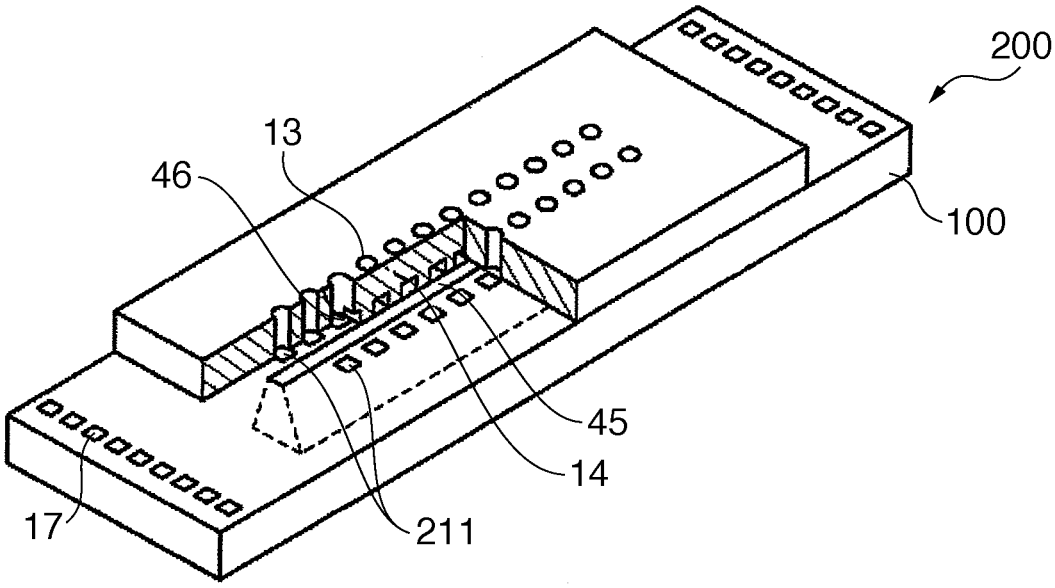
FIG. 1B is a perspective view of an inkjet printhead substrate in the printing apparatus shown in FIG. 1A.

FIG. 1B is a perspective view showing an inkjet printhead substrate 200 used in the printhead 3 shown in FIG. 1A. On the inkjet printhead substrate 200, heaters 211 are arranged on the upper side of an Si substrate 100 to generate thermal energy used to discharge a liquid. Channel formation members 14 are arranged on the heaters 211. An ink supply port (ink supply port 240) for supplying ink is formed in the Si substrate 100 to extend through the Si substrate 100.

The channel formation member 14 can be formed from the cured material of a thermoset resin such as epoxy resin. The channel formation member 14 has an orifice 13 for discharging a liquid, and the wall of a channel 46 communicating with the orifice 13. The channel formation member 14 contacts the upper side of the Si substrate 100 with this wall being inside, thereby defining the channel 46. The orifices 13 formed in the channel formation members 14 are arrayed at predetermined pitches along the ink supply port 240. A liquid supplied from the ink supply port 240 passes through the channel 46, and is film-boiled by thermal energy generated by the heater 211, generating a bubble. By a pressure generated at this time, the liquid is discharged from the orifice 13, performing a printing operation. Further, terminals 17 are formed on the upper side of the Si substrate 100 and electrically connected to the printing apparatus 1.

Figure 2:
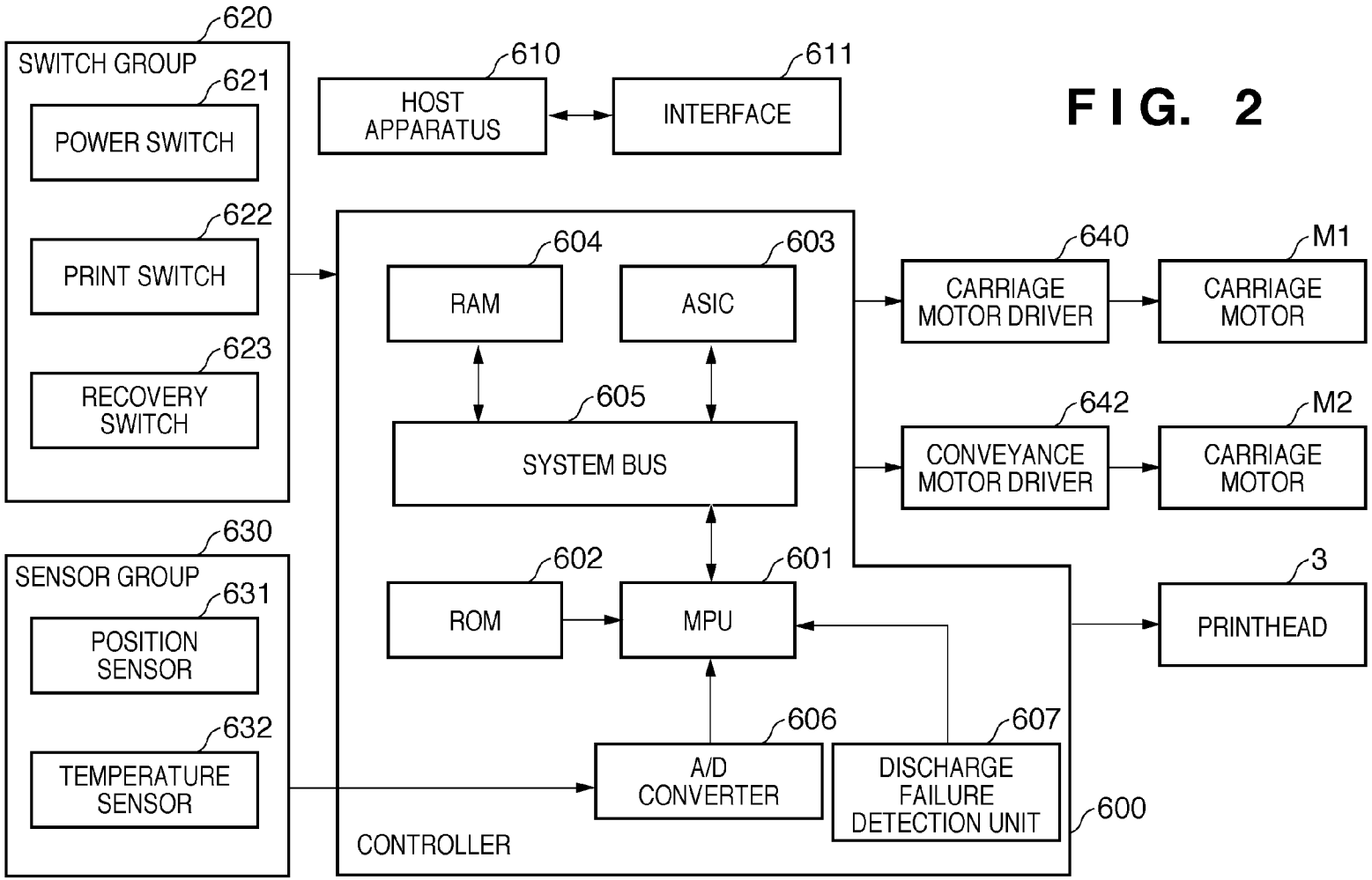
FIG. 2 is a block diagram exemplifying the functional arrangement of the printing apparatus.

The functional arrangement of the printing apparatus 1 shown in FIG. 1A will be exemplified with reference to FIG. 2.

A controller 600 includes a MPU 601, ROM 602, application specific integrated circuit (ASIC) 603, RAM 604, system bus 605, A/D converter 606, and discharge failure detection unit 607. The ROM 602 stores a program corresponding to a control sequence, a predetermined table, and other permanent data.

The ASIC 603 controls a carriage motor M1 and conveyance motor M2. The ASIC 603 also generates a control signal for controlling the printhead 3. The RAM 604 is used as an image data rasterization area, a work area for executing a program, and the like. The system bus 605 connects the MPU 601, ASIC 603, and RAM 604 to each other to exchange data. The A/D converter 606 A/D-converts analog signals input from a sensor group (to be described later), and supplies the converted digital signals to the MPU 601.

The ASIC 603 controls the discharge failure detection unit 607 to determine whether an ink discharge failure has occurred in the printhead 3 before the start of printing. The ASIC 603 then determines that a discharge failure has occurred in a heater corresponding to a nozzle determined to have a discharge failure.

A switch group 620 includes a power switch 621, print switch 622, and recovery switch 623. A sensor group 630 detects an apparatus state, and includes a position sensor 631 and temperature sensor 632. When scanning the printhead 3, the ASIC 603 transfers data to the printhead 3 to drive the heater 211 while directly accessing the storage area of the RAM 604.

The carriage motor M1 is a driving source for reciprocally scanning the carriage 2 in predetermined directions. A carriage motor driver 640 controls driving of the carriage motor M1. The conveyance motor M2 is a driving source for conveying a printing medium. A conveyance motor driver 642 controls driving of the conveyance motor M2. The printhead 3 is scanned in a direction perpendicular to the printing medium conveyance direction (scanning direction).

A computer (or image reader, digital camera, or the like) 610 serves as an image data supply source, and is called a host apparatus or the like. The host apparatus 610 and printing apparatus 1 exchange image data, commands, status signals, and the like via an interface (to be referred to as I/F) 611.

First Embodiment

The structure of an inkjet printhead substrate 200 described above will be explained below.

Figure 3A:
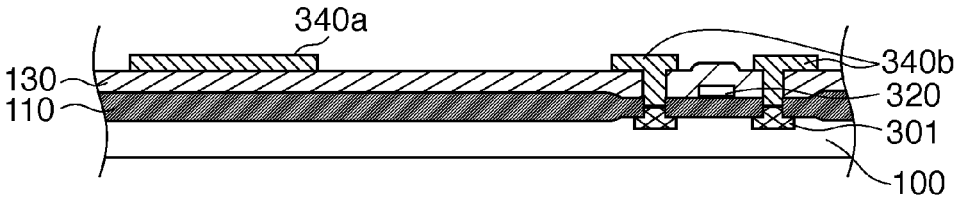
FIGS. 3A to 3H are sectional views for explaining a method of manufacturing an inkjet printhead substrate 200 according to an embodiment.
Figure 3B:
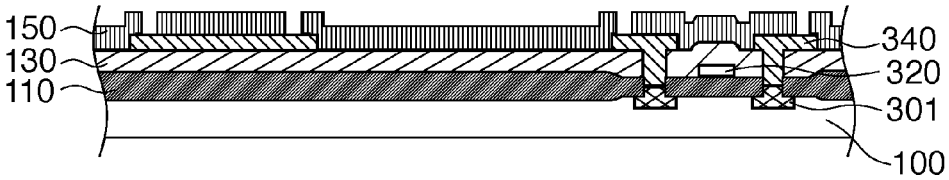
Figure 3C:
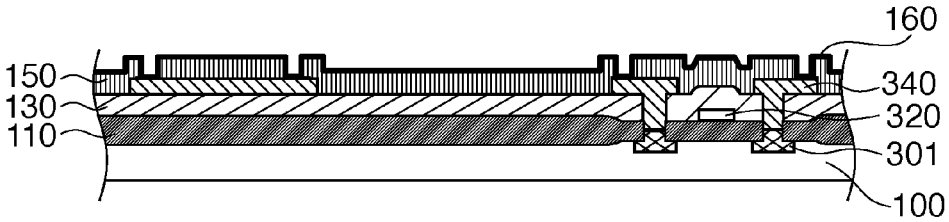
Figure 3D:
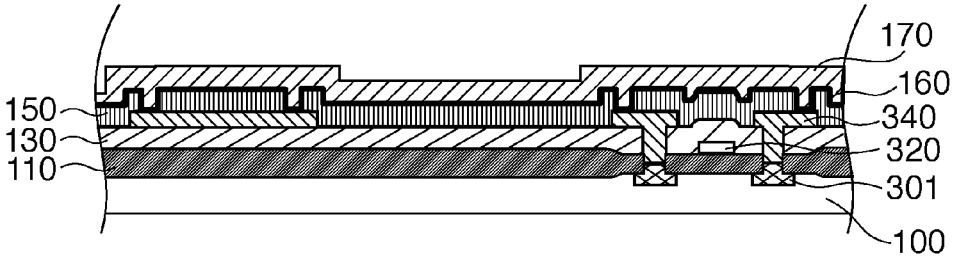
Figure 3E:
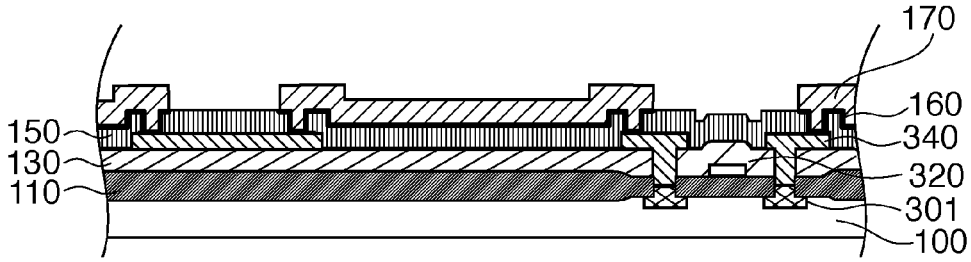
Figure 3F:
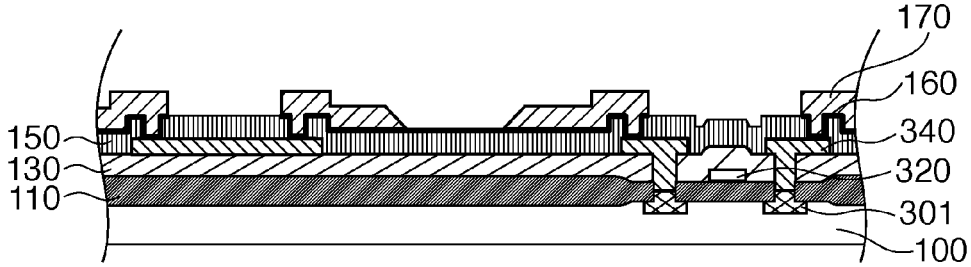
Figure 3G:
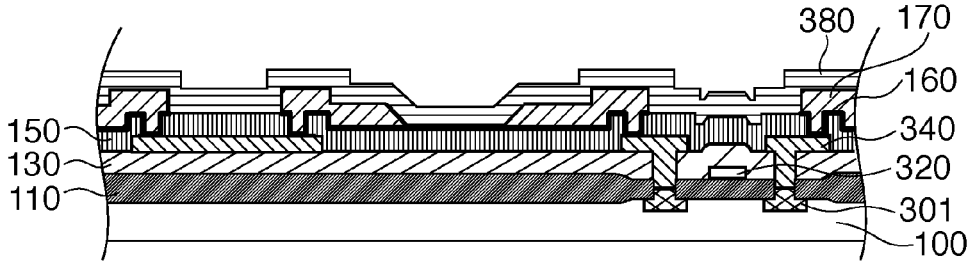
Figure 3H:
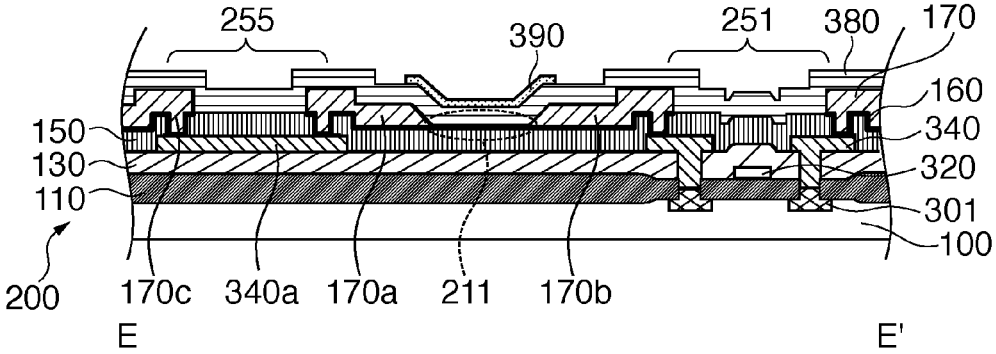
Figure 4:
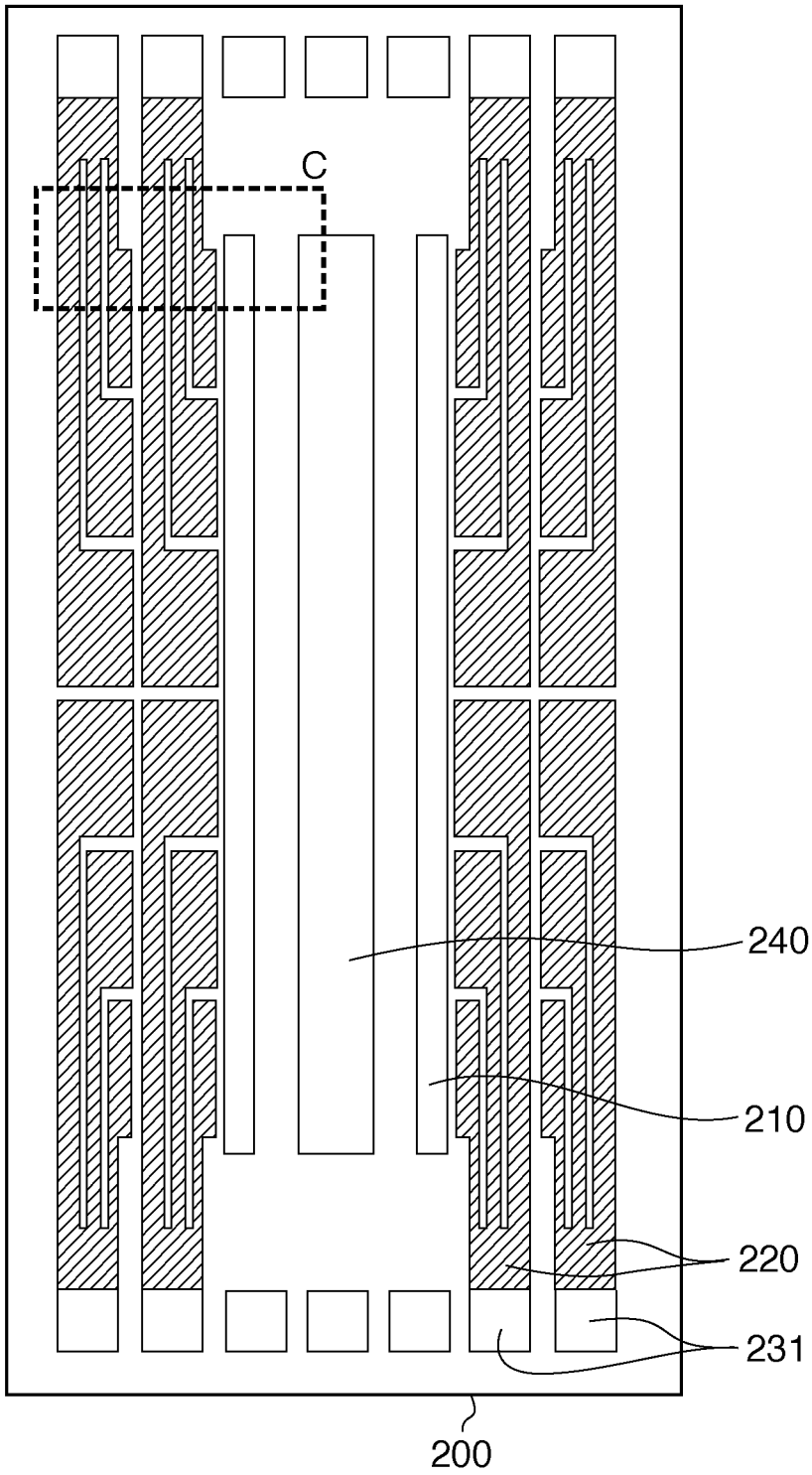
FIG. 4 is a schematic plan view of the inkjet printhead substrate.

FIG. 4 is a plan view schematically showing a second conductive layer 170 (see FIGS. 3A to 3H to be described later) of the inkjet printhead substrate 200. The inkjet printhead substrate 200 has an ink supply port 240 which extends through an Si substrate to supply ink. The ink supply port 240 has a rectangular shape. Heat generation element arrays (heater arrays) 210 in each of which heaters are arrayed are respectively arranged on the two sides of the ink supply port 240 in the longitudinal direction.

As terminals 17 at ends along the short sides of the inkjet printhead substrate 200, power supply pads 231 are arranged to supply a heater driving voltage from the power supply device of a printing apparatus 1.

The heater array 210 is divided into six groups (blocks), and a plurality of heaters belonging to the respective blocks are connected to a common heater line 220 formed from the second conductive layer 170. The common heater line 220 is formed so that the line resistances between the heaters of the respective blocks and the power supply pad 231 become almost equal.

Figure 5:
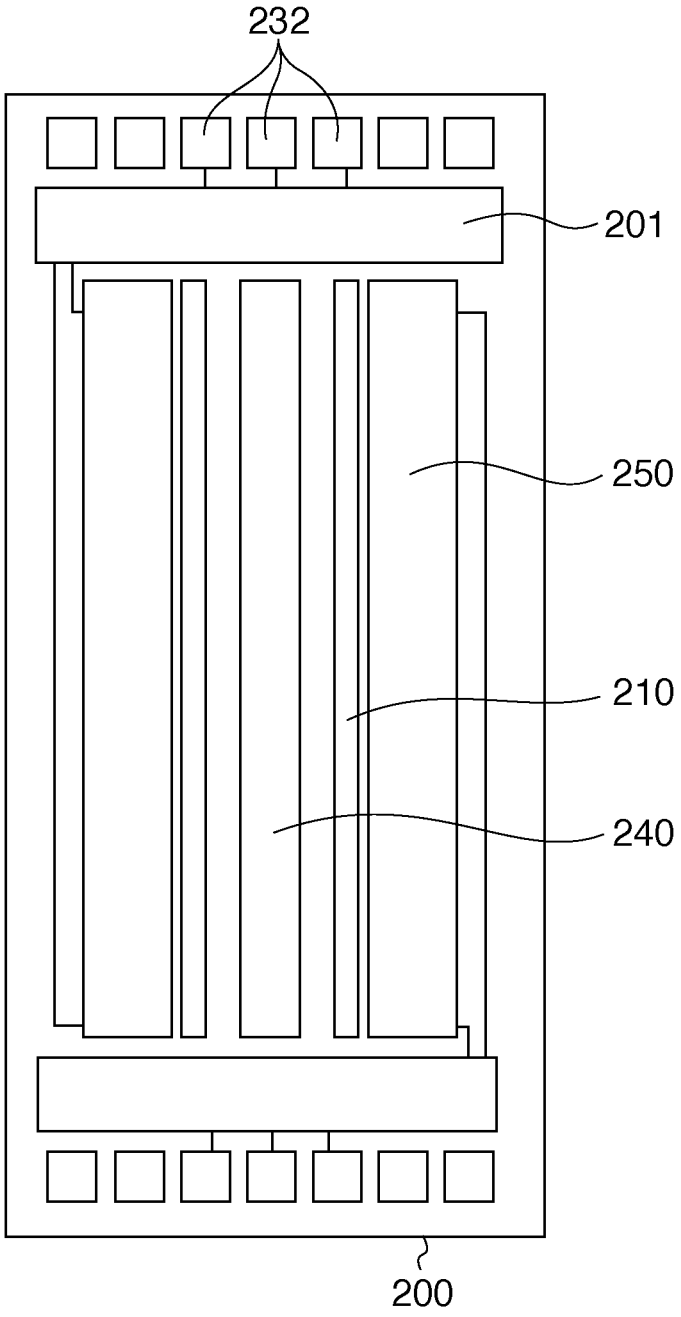
FIG. 5 is a schematic plan view of the inkjet printhead substrate.

FIG. 5 is a plan view schematically showing a control circuit 201 and driving element array 250 in the inkjet printhead substrate 200.

As the terminals 17 of the inkjet printhead substrate 200, signal pads 232 are also arranged to input an external logic signal and driving voltage of the control circuit 201. The inkjet printhead substrate 200 also includes the driving element array (switching element array) 250 formed by arraying a plurality of switching elements for performing ON/OFF control to determine whether to energize each of heaters. Further, the inkjet printhead substrate 200 includes the control circuit 201 which includes a latch circuit and shift register and rasterizes a logic signal input from the outside into a signal for controlling the switching element.

Figure 6:
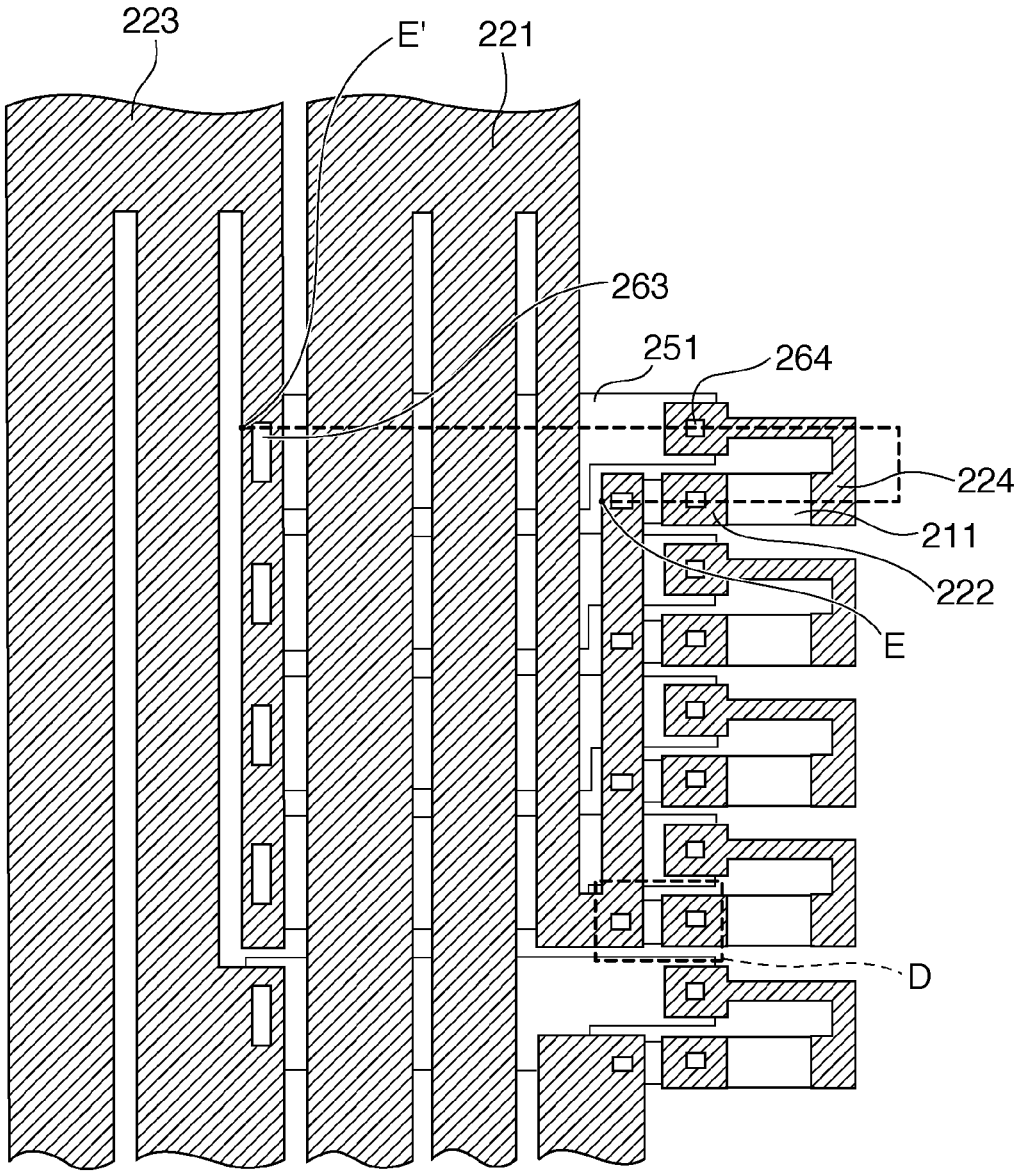
FIG. 6 is an enlarged view exemplifying a region C shown in FIG. 4.

FIG. 6 is an enlarged view showing a region C in the inkjet printhead substrate 200 shown in FIG. 4.

In the region C of the inkjet printhead substrate 200, heaters 211 and switching elements 251 are arranged. Also in the region C, a driving voltage-side common heater line 221 (first common conductive layer) is arranged to commonly supply a driving voltage to the plurality of heaters 211. Further, a ground-side common heater line 223 (second common conductive layer) is arranged to commonly ground the plurality of heaters 211. The driving voltage-side common heater line 221 and the respective heaters 211 are connected by driving voltage-side individual heater lines 222. Further, the ground-side common heater line 223 and the respective heaters 211 are connected by ground-side individual heater lines 224 via the switching elements 251. That is, the driving voltage-side common heater line 221 is a line which supplies electrical power to a plurality of the driving voltage-side individual heater lines 222. The driving voltage-side individual heater line 222 is a line which supplies electrical power input via the driving voltage-side common heater line 221 to individual heater 211. The ground-side individual heater line 224 is a line which recovers electrical power supplied to the heater 211 and outputs to the ground-side common heater line 223. The ground-side common heater line 223 is a line which recovers the electrical power output by a plurality of the ground-side individual heater lines 224.

More specifically, one end of the switching element 251 is electrically connected to the ground-side individual heater line 224 via a through hole 264 serving as the opening of a heat storage layer (second heat storage layer 150). The other end of the switching element 251 is electrically connected to the ground-side common heater line 223 via a through hole 263.

In the inkjet printhead substrate 200, a succession preventing portion 255 (see FIG. 3H) is formed in the same manufacturing step as that of forming the switching element 251 and heater in a region D, in order to prevent succession of discharge failures. Even if a passivation film layer (passivation film layer 380) corresponding to one heater 211 is disconnected, and the connected driving voltage-side individual heater line 222 corrodes, the succession preventing portion 255 can prevent propagation of the corrosion to driving voltage-side individual heater lines 222 connected to other heaters. This can prevent generation of discharge failures in other heaters 211 even if a discharge failure occurs in one heater 211.

More specifically, a metal conductive layer (heat resistance layer 160) is formed below the second conductive layer 170, and a material which hardly corrodes even if it contacts ink is interposed between the second conductive layer 170 and the first conductive layer 340. That is, the driving voltage-side individual heater line 222 formed from the second conductive layer 170 is connected to the driving voltage-side common heater line 221 via a material which hardly corrodes. As the material which hardly corrodes, the material of the heat resistance layer of the heater is used and applied in the same manufacturing step. The succession preventing portion 255 can therefore be formed without adding a manufacturing step.

FIG. 3H exemplifies a section taken along the line E-E' shown in FIG. 6. In the embodiment, the Si substrate is of p type. When viewed from an Si substrate 100, $N^+$ regions 301, a thermal oxide film layer 110, a gate electrode layer 320, a first heat storage layer 130, a first conductive layer 340, a second heat storage layer 150, a heat resistance layer 160, a second conductive layer 170, the passivation film layer 380, and an anti-cavitation layer 390 are stacked in the order named.

The switching element 251 and a control circuit such as an AND circuit are formed from MOS transistors or the like, and are formed by the $N^+$ regions 301, first conductive layer 340, gate electrode layer 320, and Si substrate 100. The embodiment will explain an example in which the switching element 251 is formed from an n-type MOS-FET. The heater 211 is formed from the heat resistance layer 160 made of a material which generates heat upon energization, and a pair of second conductive layers 170 which are formed in contact with the heat resistance layer 160 and made of a conductive material such as Al. A region between the pair of second conductive layers 170 (pair of individual line layers) is used as a heater. At this time, one 170*a* of the pair of second conductive layers 170 serves as the driving voltage-side individual heater line 222, and the other 170*b* serves as the ground-side individual heater line 224.

Further, the succession preventing portion 255 includes a detour portion 340*a* formed from the first conductive layer 340. The heat resistance layer 160 is sandwiched between the detour portion 340*a* and the one 170*a* of the second conductive layers 170. Further, the detour portion 340*a* is connected via the heat resistance layer 160 to a second conductive layer 170*c* serving as the driving power supply voltage common heater line 221. For descriptive convenience, the driving voltage-side common heater line 221 at the side of E' formed from the second conductive layer 170 is not illustrated in the sectional views of FIGS. 3A to 3H.

Material Available For Heat Resistance Layer 160)

Conductive materials which contain Al and the like and are used for the first conductive layer 340 and second conductive layer 170 readily dissolve in a solution such as ink. For this reason, a corrosion-resistant conductive material which hardly dissolves in ink than at least the first conductive layer 340 and second conductive layer 170 is used as an isolation layer. The first conductive layer 340 and second conductive layer 170 are rendered electrically conductive via the isolation layer. The isolation layer can stop corrosion of the line caused by ink, preventing succession of discharge failures. A material usable even for the heat resistance layer of the heater is applied as the isolation layer. The succession preventing portion 255 can therefore be formed without increasing the number of conventional manufacturing steps.

The material usable as the heat resistance layer of the heater needs to satisfy the following conditions: (1) a refractory material, (2) a material capable of increasing the resistance to a specific resistance of about 1,000 to 2,000 μΩ·cm, (3) no change of resistivity upon temperature change, and (4) high thermal stability. Materials which meet these conditions are Ta, W, Cr, Hf, Nb, V, Ti, Zr, Mo, Mn, Co, Ni, and La. The material needs to be an element or alloy containing at least one of them.

Corrosion-resistant materials which hardly dissolve in ink even if they contact ink are Ta, Nb, Hf, Fe, Pt, Rh, and Pd which are stable in an alkaline ink. The corrosion-resistant material needs to be an element or alloy containing at least one of them. Of these materials, Ta, Nb, Pt, and Rh are especially stable not only in an alkaline ink but also in other inks.

From this, the material which can prevent propagation of corrosion at the succession preventing portion 255 of the present invention and is available as the heat resistance layer is an element or alloy containing at least one of Ta, Nb, and Hf. To prevent corrosion caused not only by an alkaline ink but also by other inks, an element or alloy containing at least one of Ta and Nb is preferable.

Manufacturing Method

A method of manufacturing the inkjet printhead substrate 200 will be explained in sequence. First, as shown in FIG. 3A, a substrate on which $N^+$ regions 301, a thermal oxide film layer 110, a first heat storage layer 130, and a second heat storage layer 150 are stacked on an Si substrate 100 is prepared.

The $N^+$ regions 301 can be formed in the Si substrate 100 using ion implantation or the like. The thermal oxide film layer 110 can be formed by thermally oxidizing the Si substrate 100. The gate electrode layer 320 can be made of, for example, polysilicon. The first heat storage layer 130 can be formed by stacking an insulating material such as BPSG prepared by doping phosphorus into SiO. Further, a first conductive layer 340 is formed using a conductive material such as Al. As a first conductive layer 340*b* is formed for the switching element 251, a first conductive layer 340*a* serving as a detour portion is also formed by pattering at the prospective portion of the succession preventing portion 255.

As shown in FIG. 3B, a second heat storage layer 150 is formed from an insulating material mainly containing silicon on the first conductive layer 340 by plasma CVD or the like. More specifically, SiO or SiN is usable.

Next, as shown in FIG. 3C, a heat resistance layer 160 is formed simultaneously at the prospective portion of the switching element 251 and that of the succession preventing portion 255 using sputtering or the like. As a material available as the heat resistance layer 160, an element or alloy containing at least one of Ta, Nb, and Hf is used. To prevent corrosion caused not only by an alkaline ink but also by other inks, an element or alloy containing at least one of Ta and Nb is preferable.

As shown in FIG. 3D, a second conductive layer 170 is formed from a conductive material such as Al.

Then, as shown in FIG. 3E, the second conductive layer 170 and heat resistance layers 160 are removed at once from the prospective portion of the succession preventing portion 255 and that of the switching element 251 using an etching technique such as dry etching. By simultaneously patterning the second conductive layer 170 and heat resistance layer 160, heaters can be formed at high precision without generating any misalignment. As a result, an isolation layer is formed at the succession preventing portion 255.

As shown in FIG. 3F, the second conductive layer 170 is etched into a pair of individual conductive layers at the prospective portion of the heater using an etching technique such as wet etching.

As shown in FIG. 3G, a passivation film layer 380 is formed from an insulating material mainly containing silicon on the succession preventing portion 255 and switching element 251 to protect them from ink. More specifically, SiO, SIN, or the like is usable.

As shown in FIG. 3H, an anti-cavitation layer 390 can be formed from Ta or the like on the passivation film layer at the prospective portion of the heater to protect the heater from cavitation generated when bubbles disappear.

A channel formation member 14 is then formed so that the orifice 13 is located at a position corresponding to the heater 211.

With this structure, the driving voltage-side individual heater line 222 and driving voltage-side common heater line 221 are electrically connected by the first conductive layer 340*a* adjacent via the isolation layer. A material capable of preventing corrosion caused by ink is used as the material of the isolation layer. Even if the individual heater line corrodes owing to a defect generated in the passivation film layer 380 or the like, the corrosion does not directly propagate to the common heater line. Thus, an inkjet printhead substrate with high reliability in which even if a discharge failure occurs in one heater, discharge failures do not successively occur can be formed. Since the isolation layer is made of the same material as that of the heat resistance layer and formed at the same as the heat resistance layer, the inkjet printhead substrate can be formed without adding a manufacturing step.

The result of preparing the printhead 3 using the inkjet printhead substrate 200 and a printhead using a conventional inkjet printhead substrate, and conducting durability test will be explained.

Both of the substrates used in the durability test have heaters each 35 μm large on one side with a sheet resistance of 200Ω. On each side of the ink supply port, 120 heaters are arrayed at 300-dpi intervals, and a total of 240 heaters are arrayed on the two sides. Four heater driving voltage pads and four ground voltage pads are prepared, and a common heater line is connected to respective individual heater lines corresponding to 20 heaters. On the two printheads, nozzles designed to discharge a 30-pl ink droplet are formed on the two substrates. The two printheads were used to continuously print with all nozzles at a discharge frequency of 3 kHz.

As a consequence, the two heads generated discharge failures owing to disconnection of the passivation film layer in one heater at about $2.1\times10^8$ pulses. In the conventional printhead, after a discharge failure occurred owing to disconnection of the passivation film layer in one heater, the 19 remaining heaters of a group to which the heater having the discharge failure belonged became unavailable upon applying a voltage of about $0.1\times10^7$ pulses.

To the contrary, in the printhead 3 using the inkjet printhead substrate 200 according to the first embodiment, even if a voltage of about $0.5\times10^7$ pulses was applied after a discharge failure occurred in one heater, no new discharge failure occurred. Hence, an inkjet printhead substrate with high reliability in which even if a discharge failure occurs in one heater, discharge failures do not successively occur can be formed without adding a manufacturing step.

Second Embodiment

Figure 7A:
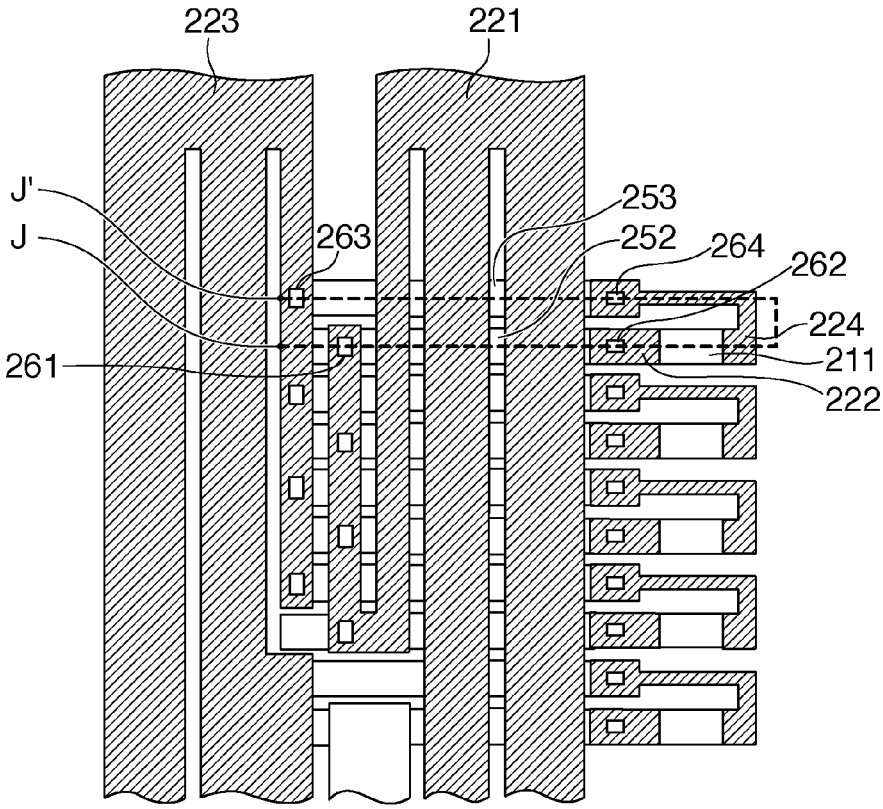
FIG. 7A is an enlarged view exemplifying the region C shown in FIG. 4.

The second embodiment will be described next. FIG. 7A is an enlarged view exemplifying a region C in an inkjet printhead substrate 200 shown in FIG. 4. A description of the same materials and structure used as those in the first embodiment will not be repeated.

In the region C of the inkjet printhead substrate 200, heaters 211, and first switching elements 252 and second switching elements 253 formed from n-type MOS-FETs are arranged. Also in the region C, a driving voltage-side common heater line 221, a ground-side common heater line 223, driving voltage-side individual heater lines 222, and ground-side individual heater lines 224 are arranged.

The switching elements 252 and 253 are formed from a first conductive layer 340, gate electrode layer 320, and thermal oxide film layer 110 which are lower than the heater 211 and the common heater lines 221 and 223. The second switching element 253 is electrically connected to the ground-side individual heater line 224 via a through hole 264 serving as the opening of a second heat storage layer 150, and electrically connected to the ground-side common heater line 223 via a through hole 263. The first switching element 252 is electrically connected to the driving voltage-side individual heater line 222 via a through hole 262 serving as the opening of the second heat storage layer 150, and electrically connected to the driving voltage-side common heater line 221 via a through hole 261.

Figure 7B:
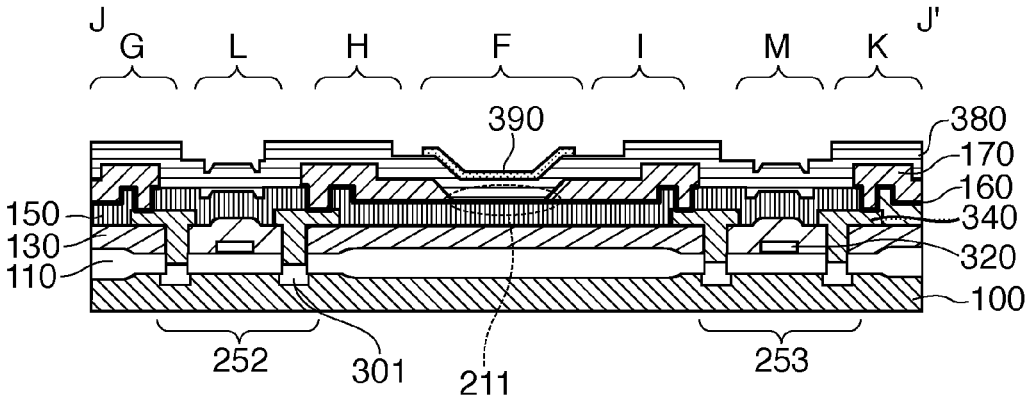
FIG. 7B is a sectional view exemplifying a section taken along the line J-J' shown in FIG. 7A.

FIG. 7B is a view of a section taken along the line J-J' shown in FIG. 7A passing from the switching element 252 through the driving voltage-side individual heater line 222, heater 211, ground-side individual heater line 224, and switching element 253.

In FIG. 7B, an Si substrate 100, the thermal oxide film layer 110, the gate electrode layer 320, the first heat storage layer 130, the first conductive layer 340, and the second heat storage layer 150 are formed. Further, a heat resistance layer 160, second conductive layer 170, passivation film layer 380, and anti-cavitation layer 390 are formed.

A region F corresponds to the heater 211. A region G in the second conductive layer 170 corresponds to the driving voltage-side common heater line 221. A region H in the second conductive layer 170 corresponds to the driving voltage-side individual heater line 222. A region I in the second conductive layer 170 corresponds to the ground-side individual heater line 224. A region K in the second conductive layer 170 corresponds to the ground-side common heater line 223. For descriptive convenience, the driving voltage-side common heater line 221 at the side of J' formed from the second conductive layer 170 is not illustrated in the sectional view shown in FIG. 7B.

Similar to the first embodiment, the heat resistance layer 160 is sandwiched between the first conductive layer 340 and the second conductive layer 170 in the switching elements 252 and 253.

By using, as the heat resistance layer 160, an element or alloy material containing at least one of Ta, Nb, and Hf, the switching elements 252 and 253 can be used as the succession preventing portion. To prevent corrosion caused not only by an alkaline ink but also by other inks, an element or alloy containing at least one of Ta and Nb is preferable. Such switching elements 252 and 253 can be formed at the same time, so the succession preventing portions can be simultaneously formed at portions connected to the common heater line and the individual heater line.

Further in the switching elements 252 and 253, an $N^+$ region 301 formed in the Si substrate 100, and the first conductive layer 340 are formed in contact with each other. The driving voltage-side individual heater line 222 and driving voltage-side common heater line 221 are connected by the switching element 252 via the Si substrate 100 in a region L. The ground-side individual heater line 224 and ground-side common heater line 223 are connected by the switching element 253 via the Si substrate 100 in a region M. When predetermined voltages are applied to the switching elements 252 and 253, the common heater line and individual heater line are electrically connected to each other.

The result of preparing a printhead 3 using the inkjet printhead substrate 200 according to the second embodiment and a printhead using a conventional inkjet printhead substrate, and conducting a durability test will be explained. The printhead (including the inkjet printhead substrate) used in the durability test is the same as the conventional one described in the first embodiment.

As a result of the durability test, the two heads generated discharge failures owing to disconnection of the passivation film layer in one heater at about $2.1\times10^8$ pulses. In the conventional printhead, after a discharge failure occurred owing to disconnection of the passivation film layer in one heater, the 19 remaining heaters of a group to which the heater having the discharge failure belonged became unavailable upon applying a voltage of about $0.1\times10^7$ pulses.

To the contrary, in the printhead 3 using the inkjet printhead substrate 200 according to the second embodiment, even if a voltage of about $0.5\times10^7$ pulses was applied after a discharge failure occurred in one heater, no new discharge failure occurred.

Printing control for an inkjet printhead substrate having the arrangement shown in FIGS. 7A and 7B will be exemplified.

Figure 8:
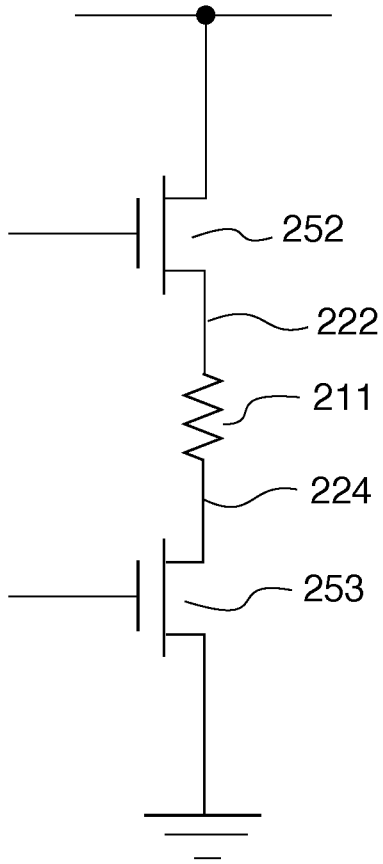
FIG. 8 is a schematic circuit diagram of a circuit for driving a heater in the printing apparatus.

Prior to a description of printing control, an outline of heater driving will be briefly explained. As shown in FIG. 8, the heater 211 is electrically connected to the switching elements (MOS-FETs) 252 and 253 via the driving voltage-side individual heater line 222 and ground-side individual heater line 224. When driving the heater, the driving voltage line-side switching element 253 is always kept ON, and the ground line-side switching element 252 controls the pulse width of the heater current.

Figure 9:
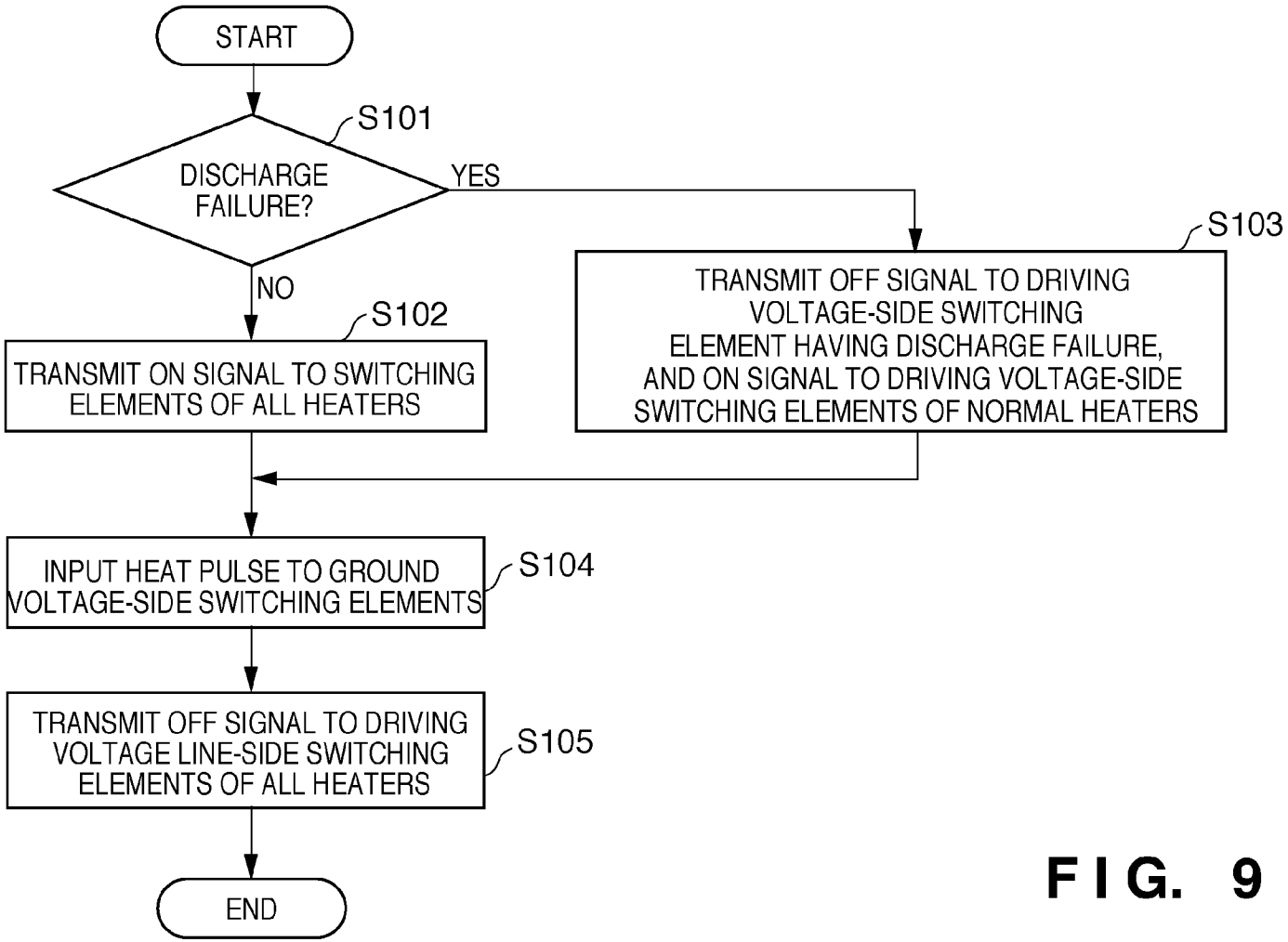
FIG. 9 is a flowchart exemplifying printing control processing in the printing apparatus.
Figure 10:
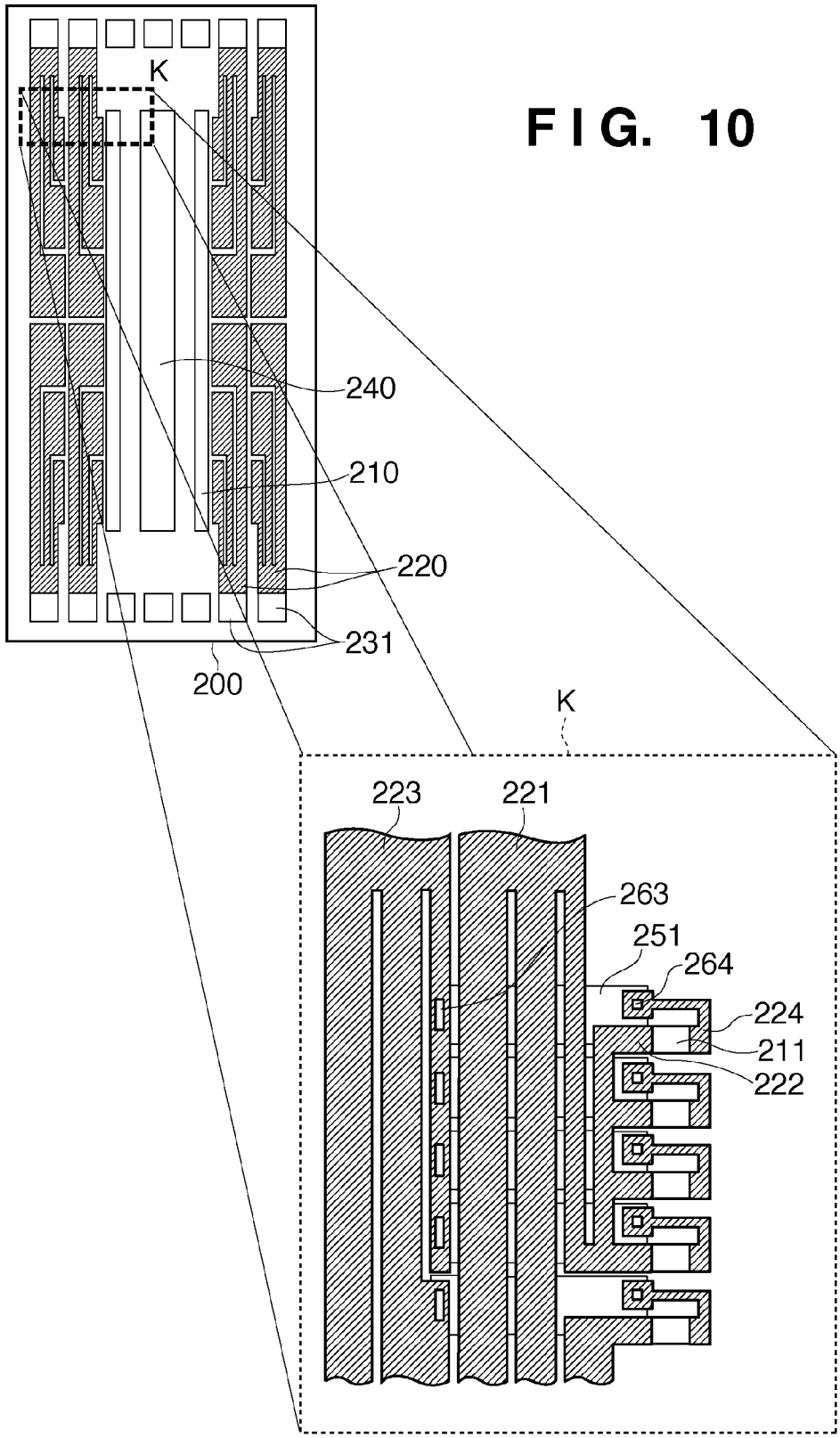
FIG. 10 is a view exemplifying a conventional technique.
Figure 11:
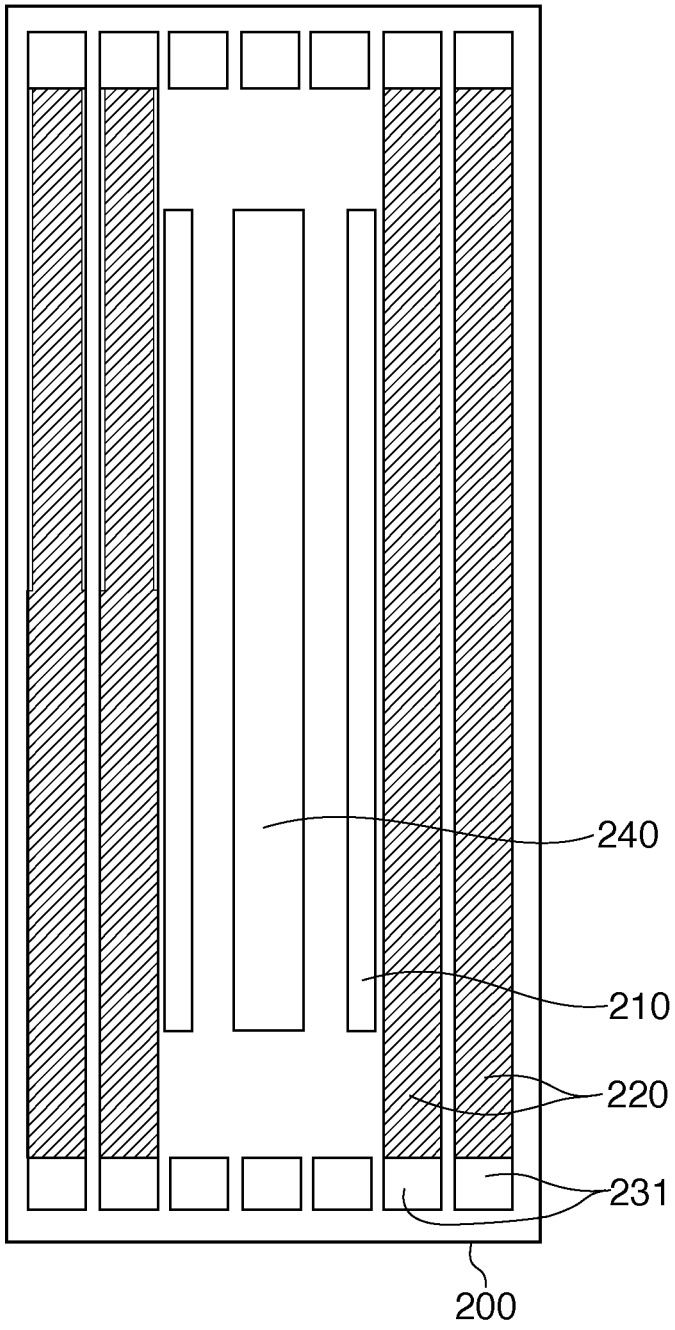
FIG. 11 is a view exemplifying a conventional technique.
Figure 12A:
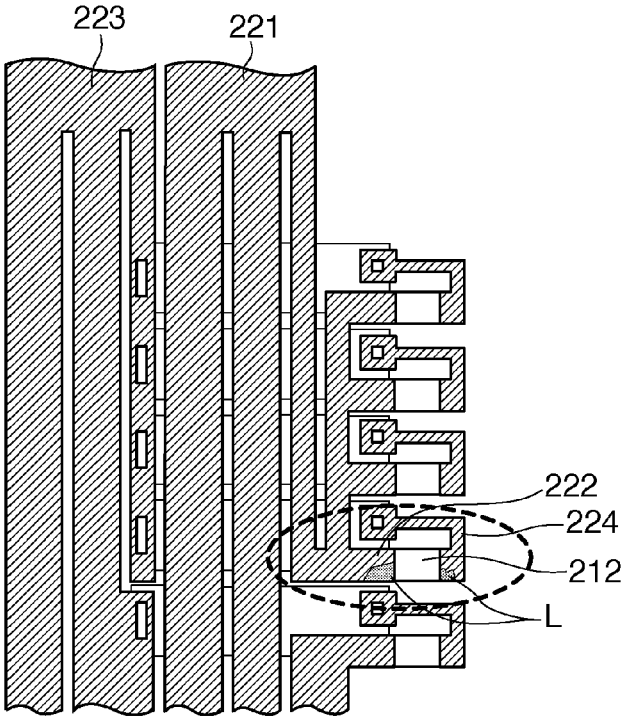
FIGS. 12A and 12B are views exemplifying a conventional technique.
Figure 12B:
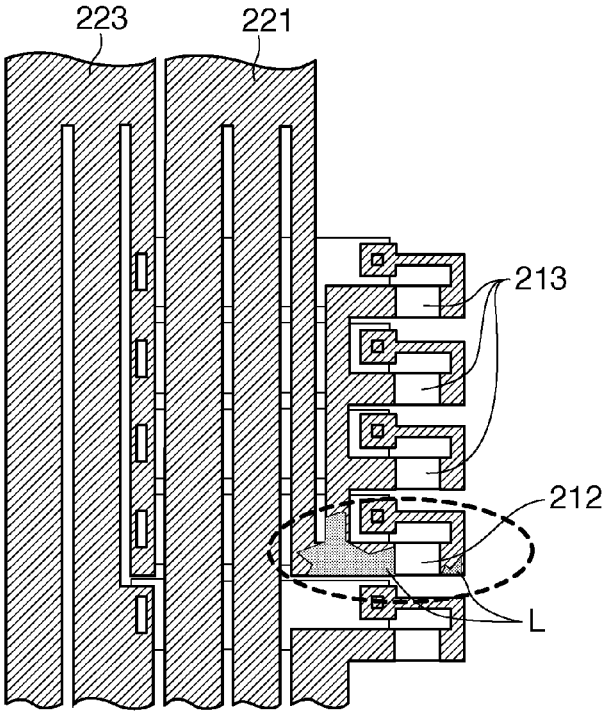

Printing control processing in a printing apparatus 1 shown in FIG. 1A will be exemplified with reference to FIG. 9. A case in which printing control processing is performed excluding a heater detected to have a discharge failure will be explained.

Before the start of printing by the discharge failure detection unit 607, the printing apparatus 1 determines whether there is a heater having a discharge failure. If the printing apparatus 1 determines that there is no heater having a discharge failure (NO in step S102), it transmits an ON signal to the driving voltage line-side switching elements (first switching elements) 252 of all heaters (step S103).

If it is determined that there is a heater having a discharge failure (YES in step S102), the printing apparatus 1 transmits an OFF signal to the driving voltage-side switching element 252 corresponding to this heater, and an ON signal to the driving voltage line-side switching elements 252 of the remaining heaters (step S103). After that, the printing apparatus 1 inputs a pulse wave to the ground-side switching elements (second switching elements) 253 to control driving of the heaters 211 (step S104). At the end of the driving control, the printing apparatus 1 transmits an OFF signal to the ground-side switching elements 253 (step S105).

As described above, according to the second embodiment, the first and second conductive layers are connected via the isolation layer, and the switching element (MOS-FET) is interposed between the individual heater line and the common heater line. Since the isolation layer made of a material resistant to corrosion caused by ink exists between the first and second conductive layers, corrosion of the individual heater line does not directly propagate to the common heater line. Therefore, an inkjet printhead substrate with high reliability in which even if a discharge failure occurs in one heater, discharge failures do not successively occur can be formed. Since the isolation layer is simultaneously formed from the same material as that of the heat resistance layer, the inkjet printhead substrate can be formed without adding a manufacturing step.

In printing control of the second embodiment, a switching element corresponding to a heater detected to have a discharge failure changes to the OFF state, so no voltage is applied to the connected individual heater line. This can suppress propagation of corrosion of the heater line.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2010-044629 filed on Mar. 1, 2010, which is hereby incorporated by reference herein in its entirety.

What is claimed is:

1. An inkjet printhead substrate comprising:

a pair of individual conductive layers configured to supply electrical power to a heat generation element which generates thermal energy for discharging ink;

a first common conductive layer configured to be connected to one of said pair of individual conductive layers, and supply electrical current to said pair of individual conductive layers;

a second common conductive layer configured to be connected to the other of said pair of individual conductive layers, wherein said electrical current flows into said second common conductive layer from said pair of individual conductive layers; and an isolation layer configured to be provided between said one of said pair of individual conductive layers and said first common conductive layer, and between the other of said pair of individual conductive layers and said second common conductive layer, wherein said isolation layer is formed from a conductive material which has a lower solubility in ink than a material used for said pairs of individual conductive layers, said first common conductive layer and said second common conductive layer.

2. The substrate according to claim 1, wherein the heat generation element is formed by a heat resistance layer which generates heat upon energization, and the heat resistance layer and the isolation layer are formed from the same material.

3. The substrate according to claim 2, wherein the heat resistance layer and the isolation layer are formed as continuous layer.

4. The substrate according to claim 2, wherein the heat resistance layer is made of single metal or alloy, which include at least one material selected from Ta, Nb, and Hf.

5. The substrate according to claim 1, wherein said second common conductive layer and said other of said pair of individual conductive layers are connected via a switching element configured to determine whether to energize the heat generation element.

6. The substrate according to claim 1, wherein said first common conductive layer and said one of said pair of individual conductive layers are connected via a first switching element configured to determine whether to energize the heat generation element, and said second common conductive layer and the other of said pair of individual conductive layers are connected via a second switching element configured to determine whether to energize the heat generation element.

7. An inkjet printing apparatus comprising:

an inkjet printhead using an inkjet printhead substrate defined in claim 6;

a control unit configured to control a first switching element and a second switching element; and a detection unit configured to detect whether ink has been discharged from an orifice arranged in correspondence with a heat generation element, wherein when said detection unit detects that no ink has been discharged, said control unit controls to turn off at least one of the first switching element and second switching element which are connected to the heat generation element.

8. The substrate according to claim 1, wherein said the substrate includes a plurality of said pairs of individual conductive layers, said first common conductive layer is connected to one of each of said pairs of individual conductive layers, and said second common conductive layer is connected to the other of each of said pairs of individual conductive layers.

9. An inkjet printhead using an inkjet printhead substrate defined in claim 1.

10. An inkjet printhead substrate comprising:

a plurality of pairs of individual conductive lines, each configured to supply electrical power to a heat generation element which generates thermal energy for discharging ink;

a first common conductive line configured to be connected to one line of each of the plurality of pairs of individual conductive lines for supplying electrical current to the plurality of pairs of individual conductive lines;

a second common conductive line configured to be connected to the other line of each of the plurality of pairs of individual conductive lines, wherein the electrical current flows into the second common conductive line from the plurality of pairs of individual conductive lines;

a plurality of first conductive portions, each configured to electrically connect the one line of each of the plurality of pairs of individual conductive lines and the first common conductive line, a plurality of second conductive portions, each configured to electrically connect the other line of each of the plurality of pairs of individual conductive lines and the second common conductive line; and an isolation layer configured to be provided between the one line of each of the plurality of pairs of individual conductive lines and each of the plurality of first conductive portions, and between the other line of each of the plurality of pairs of individual conductive lines and each of the plurality of second conductive portions, wherein the isolation layer is formed from a conductive material which has a lower solubility in ink than a material used for the plurality of pairs of individual conductive lines.

11. The substrate according to claim 10, wherein the heat generation element is formed by a heat resistance layer which generates heat upon energization, and the heat resistance layer and the isolation layer are formed from the same material.

12. The substrate according to claim 11, wherein the heat resistance layer and the isolation layer are formed as continuous layer.

13. The substrate according to claim 11, wherein the heat resistance layer is made of single metal or alloy, which includes at least one material selected from Ta, Nb, and Hf.

14. The substrate according to claim 10, wherein the first common conductive line and the one line of each of the plurality of pairs of individual conductive lines are connected via a first switching element configured to determine whether to energize the heat generation element, and the second common conductive line and the other line of each of the plurality of pairs of individual conductive lines are connected via a second switching element configured to determine whether to energize the heat generation element.

15. The substrate according to claim 10, wherein the isolation layer is provided between the one line of each of the plurality of pairs of individual conductive lines and each of the plurality of first conductive portions and between the other line of each of the plurality of the pairs of individual conductive lines and each of the plurality of second conductive portions in a direction perpendicular to the substrate.

16. An inkjet printhead substrate comprising:

a heat resistance layer configured to form a plurality of heat generation elements each of which generates thermal energy for discharging ink;

a plurality of pairs of individual conductive lines, each configured to supply electrical power to each of the plurality of heat generation elements, a first common conductive line configured to be connected to one line of each of the plurality of pairs of individual conductive lines for supplying electrical current to the plurality of pairs of individual conductive lines;

a second common conductive line configured to be connected to the other line of each of the plurality of pairs of individual conductive lines, wherein the electrical current flows into the second common conductive line from the plurality of pairs of individual conductive lines;

a plurality of first conductive portions, each configured to electrically connect the one line of each of the plurality of pairs of individual conductive lines and the first common conductive line; and a plurality of second conductive portions, each configured to electrically connect the other line of each of the plurality of pairs of individual conductive lines and the second common conductive line, wherein the heat resistance layer is provided between the one line of each of the plurality of pairs of individual conductive lines and each of the plurality of first conductive portions, and between the other line of each of the plurality of pairs of individual conductive lines and each of the plurality of second conductive portions.

17. The substrate according to claim 16, wherein the heat resistance layer is formed from a conductive material which has a lower solubility in ink than a material used for the pair of individual conductive lines.

18. The substrate according to claim 16, wherein the first common conductive line and the one line of each of the plurality of pairs of individual conductive lines are connected via a first switching element configured to determine whether to energize the heat generation element, and the second common conductive line and the other line of each of the plurality of pairs of individual conductive lines are connected via a second switching element configured to determine whether to energize the heat generation element.

19. The substrate according to claim 16, wherein the heat resistance layer is provided between the one line of each of the plurality of pairs of individual conductive lines and each of the plurality of first conductive portions and between the other line of each of the plurality of pairs of individual conductive lines and each of the plurality of second conductive portions in a direction perpendicular to the substrate.

* * * * *